United States Patent [19]

Tesch

[11] Patent Number: 4,722,179

[45] Date of Patent: Feb. 2, 1988

[54] HINGE FOR A WATCHBAND, BRACELET OR THE LIKE

[76] Inventor: Bernard Tesch, Im Baumgarten 4, CH 6373, Switzerland

[21] Appl. No.: 888,426

[22] Filed: Jul. 23, 1986

[51] Int. Cl.[4] ..... F16G 13/00; A44C 5/00

[52] U.S. Cl. ..... 59/82; 16/379; 224/167; 368/282; 63/7

[58] Field of Search ..... 16/224, 250, 376, 377, 16/379, 380, 382, DIG. 49; 49/398; 224/167 X; 206/18; D10/32; 368/281, 282; 403/162; 224/160, 168, 177, 180; 63/3, 7, 9; 59/82, 84

[56] References Cited

U.S. PATENT DOCUMENTS

| | | | |
|---|---|---|---|
| 3,259,283 | 7/1966 | Moinat . | |
| 4,561,077 | 12/1985 | Mock | 368/282 |

FOREIGN PATENT DOCUMENTS

| | | | |
|---|---|---|---|
| 253947 | 1/1912 | Fed. Rep. of Germany | 368/282 |
| 1007537 | 6/1955 | Fed. Rep. of Germany . | |
| 1228453 | 1/1965 | Fed. Rep. of Germany . | |
| 2048318 | 10/1970 | Fed. Rep. of Germany . | |
| 288518 | 10/1950 | France . | |
| 1108213 | 9/1954 | France . | |
| 2287869 | 10/1974 | France . | |
| 2523195 | 3/1983 | France . | |
| 328140 | 4/1958 | Switzerland | 368/282 |
| 591221 | 6/1975 | Switzerland . | |
| 647660 | 6/1982 | Switzerland . | |
| 650388 | 1/1983 | Switzerland . | |
| 22687 | of 1906 | United Kingdom | 403/163 |

*Primary Examiner*—Nicholas P. Godici
*Assistant Examiner*—G. Reid
*Attorney, Agent, or Firm*—Diller, Ramik & Wight

[57] ABSTRACT

A hinge for a watchband, bracelet or the like which includes adjacent interconnected elements defining therebetween a cylindrical or a spherical chamber, a cylindrical or spherical housing in the chamber, a pair of connecting studs pivotally connected to each other within the housing and projecting outwarding therefrom through cross-bores, the studs being connected to the links and the cylindrical or spherical housing totally hiding the connection through gaps at top or bottom sides of the links in any position of relative articulation.

23 Claims, 4 Drawing Figures

HINGE FOR A WATCHBAND, BRACELET OR THE LIKE

BACKGROUND OF THE INVENTION

This invention relates to hinges in general and specifically to a novel hinge for a wristwatch band, wristband, armband, bracelet or the like which includes at least two relatively pivoted parts or elements hinged to each other by an articulating joint or pivot.

Conventional articulating, pivoted or hinged joints are known for watch wristband, bracelets, or the like, and these generally interconnect individual links to each other and/or end links of a link band to a watch housing or case. Hinges of this type, particularly when used for watchbands, bracelets or the like, must be constructed such that irrespective of the amount associated adjacent links are moved, the gap therebetween is maintained as small as possible and/or any joints between adjacent links must not be visible through the gap therebetween. To the latter end it is conventional to use cover strips on adjacent pivotally connected links so that the pivots between the links cannot be seen when the links are pivoted to increase the gap or gaps therebetween. Essentially, such cover strips bridge the gap between adjacent links and thus hide any pivotal connectors which might otherwise be exposed through the gap or gaps absent the cover strips. While such cover strips achieve a "closed" appearance of the associated band and cover elements of the pivot or articulating joint between the links, such cover strips cannot be applied in all cases. As an example, when the links of a band must be relatively strong and therefore are connected to each other by relatively strong and large pivots, it is virtually impossible to provide a covering strip to cover the gaps, particularly between the last two links of a watchband and the pivotal connection thereof with the watch housing or casing.

SUMMARY OF THE INVENTION

In accordance with the present invention, a watchband, bracelet, wristband, armband or the like is provided which assures that all hinge, pivot or articulating joints between individual links, band parts, or links and the watch housing and/or casing are virtually incapable of being seen when adjacent links are pivoted relative to each other or to the watch housing/casing. Moreover, the hinge, pivot or articulating joint between the links or the links and the watch housing are hidden in the absence of conventional cover strips.

The purposes of the invention thus far described are achieved by essentially placing a hinge, pivot or articulating joint within a housing such that the housing virtually encloses the pivot or hinge in its entirety, yet portions of the pivot or hinge project through the housing and are connected to adjacent links or between an end link and an associated watching casing. In this fashion the housing effectively hides the pivot or articulating joint when the wristband is pivoted and gaps are created between adjacent links. When any such gap exists, one sees the housing through the gap and the housing itself hides the pivots or articulating joints from view.

In keeping with the invention, the housing for the hinge or pivot is preferably a rotating body defined by a surface of rotation, such as a cylindrical housing or a spherical housing, and in each case cross-bores are provided therethrough through which project connecting studs which are in turn pivotally connected to each other by one or more pivot pins. The connecting studs are preferably threaded to adjacent links or elements of the associated wristband. Thus, when the elements or adjacent links are articulated or pivoted and gaps are created, the pivot pin, studs, etc. are all hidden from view by the cylindrical or spherical housings, yet free articulation/pivoting of adjacent links is readily provided.

In further accordance with this invention the housing for the hinge or articulating joint is preferably formed as a single element but can be made of several housing parts. In the case of a single housing element, the element is preferably cylindrical and has at axially opposite ends thereof a single pair of pivotally connected connecting studs. However, in the case of a housing made of two separate parts, each part is preferably spherical and each spherical housing carries a separate pair of pivotally connected studs which are in turn connected to associated links or an end link and a watch casing or housing. However, in each case whether the housing is a single cylindrical housing or a pair of spherical housings, the housings provide as wide a pivoting angle as possible of the elements or links relative to each other, and in all cases the pivot or hinges formed thereby are hidden from view through the gaps between the links by the housings. In further accordance with this invention, both in the case of a cylindrical housing and spherical housings, the housings include cross-bores which in part house the pivoting studs and through which project the studs, and these cross-bores are prevented from being exposed through the link gaps by appropriate stops or stop faces of adjacent links or elements. Thus, as any pair of adjacent links is pivoted between opposite limits thereof, the cross-bores cannot be seen through the gaps because the stops or stop surfaces of the adjacent links will abut each other and prevent the cross-bores from being exposed through the link gaps.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

Figure 1:
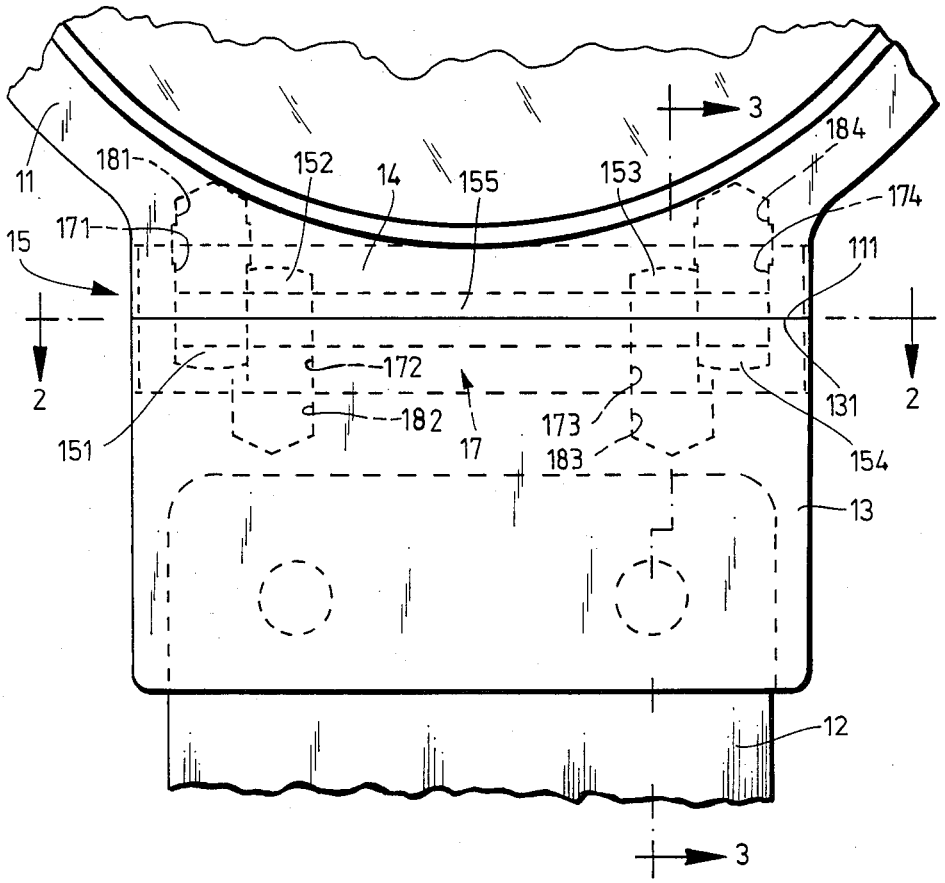
FIG. 1 is a fragmentary top plan view of a watchband and illustrates a watch housing or casing, a connection link or element of a wristband adjacent thereto, and a hinge therebetween.
Figure 2:
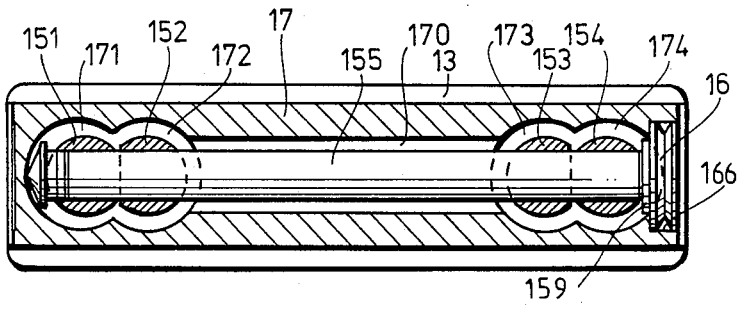
FIG. 2 is a cross sectional view taken generally along line 2—2 of FIG. 1 and illustrates details of the hinge including a cylindrical housing, a pivot pin internally of the housing, and two pairs of connecting studs with a stud of each pair being connected to the watch housing and the adjacent wristband link.
Figure 3:
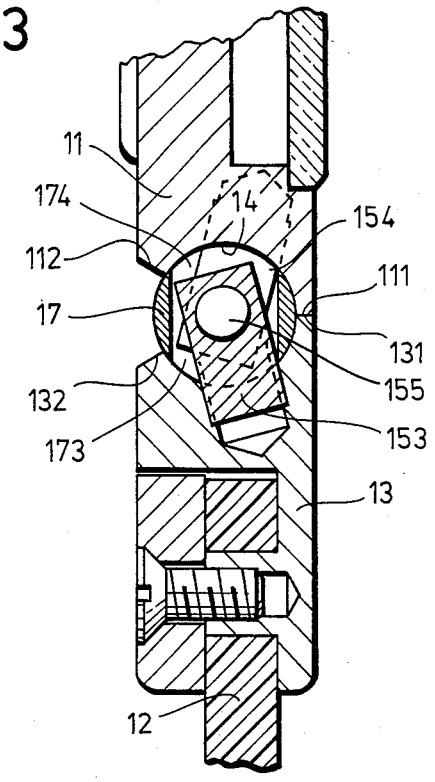
FIG. 3 is a fragmentary cross sectional view taken generally along line 3—3 of FIG. 1 and illustrates the manner in which the studs and pivot pins secure the links articulately to each other and the manner in which the housing prevents the studs and pivot pin from being seen through gaps between the links.

A hinge constructed in accordance with this invention is fully illustrated in FIGS. 1–3 of the drawings in association with a pair of elements 11, 13 which are respectively a watch housing or case and a connection link or element of a wristband 12. The wristband 12 is shown as being constructed from a piece of plastic or the like having an end conventionally fastened to the connection link 13, as shown best in FIG. 3, but the wristband 12 can be as well a plurality of individually interconnected, hinged or otherwise articulated links conventionally connected to each other or connected to each other by a hinge, pivotal connection or articulating connection 15 of this invention.

The hinge 15 is defined in part by a generally cylindrical chamber 14 formed as two semi-cylindrical chambers in opposing relationship to each other, one such semi-cylindrical chamber being formed in the watch housing 11 and the other semicylindrical chamber being formed in the connection link 13. The cylindrical chamber 14 is thus essentially located between upper opposing outside top edges 111, 131 (FIGS. 1 and 3) of the respective housing or element 11 and the connection link or element 13 and similar inside or bottom edges 112, 132 (FIG. 3) of these same elements 11, 13. The edges 111, 131 are shown in abutment in FIG. 3 which limits relative pivoting between the elements 11, 13 in one direction, whereas opposite pivoting of the elements 11, 13 is limited by the abutment between the edges 112, 132, as is readily visualized in FIG. 3.

The hinge 15 is defined in part by a cylindrical or cylindrical housing 17 (FIGS. 2 and 3) which is snugly received in the cylindrical chamber 15 and extends the entire length thereof which, as is best illustrated in FIGS. 1 and 2, is generally the overall width of the connection link or element 13. The cylinder or cylindrical housing 17 includes an axial bore 170 (FIG. 2) and at axially opposite ends thereof are pairs of generally radial cross-bores 171, 172 and 173, 174 to the left and right, respectively, in FIG. 2. The cross-bores 171–174 partially receive and house connecting eyes or studs 151–154, respectively, each of which has a bore (unnumbered) through which passes the pin 155 (FIG. 2). Thus, each of the studs 151–154 is pivoted to the pin 155 at a first axial end (unnumbered) of each of the studs whereas axially opposite ends (unnumbered) of each of the studs 151–154 project generally radially outwardly through the respective cross-bores 171–174 and are threaded in threaded bores 181–184 (FIGS. 1 and 3). The threaded bores 181, 184 are formed in the watch housing or element 11, whereas the threaded bores 182, 183 are in the connection link or element 13. Accordingly, and as best illustrated in FIG. 3, the threaded end of the stud 154 connects the stud to the watch casing 11 through its threaded bore 184 while the threaded end of the stud 153 is connected through the threaded bore 183 to the connection liink 13. The identical relationship exists relative to the elements 151, 181 and 152, 182.

The axial bore 170 (FIG. 2) of the cylinder 17 which accommodates the pin 155 is preferably provided with a counterbore 166 (FIG. 2) which receives and seats a head 159 of the pin 155. A cover or cap 16 closes the counterbore 166. Obviously, the cover 16 can be removed to similarly remove and/or reinsert the pin 155 for disassembling, assembling, or reassembling the hinge 15 relative to the elements 11, 13.

As is best illustrated in FIG. 3, the cross-bores 173, 174 are so positioned relative to the axes of the studs 153, 154, the axes of the threaded bores 183, 184 and the surfaces 111, 131 and 112, 132 that irrespective of the gap between the surfaces 111, 131 and 112, 132, the housing 17 hides the connection or hinge 15 and the various components thereof, including the pivot pin 155 and the studs 151–154. Thus, in the position of the elements 11, 13 in FIG. 3, the gap between the edges 112, 132 is at a maximum yet only the housing 17 is visible and neither the cross-bores 173, 174 nor the studs 153, 154 associated therewith can be seen when the hinge 15 is viewed from the left in FIG. 3. Obviously, if the hinge 15 is moved to decrease the gap between the surfaces 112, 132 the gap between the surfaces 111, 131 increases, but again this gap opens to expose only the exterior surface (unnumbered) of the cylinder or housing 17, again hiding the studs 153, 154 and/or the associated cross-bores 173, 174. A like relationship exists, of course, relative to the studs 151, 152 and the cross-bores 171, 172 thereof. Hence, in all conditions of relative pivoting between the elements 11 and 13, the gaps between the edges 111, 131 and 112, 132 expose only the exterior surface of the housing 17 and none of the elements of the hinge 15. Therefore, the entire connection or hinge 15 between the elements 11, 13 is highly esthetic, be the same viewed from left or right in FIG. 3 and irrespective of the particular relative pivoted position of the elements 11, 13.

It is also to be particularly noted with respect to FIG. 3 that with the studs 153, 154 fixed to the pivot pin 155, as the elements 11, 13 are pivoted, the studs 153, 154 move within the respective counterbores 173, 174 thereof. Absent the abutment of the surfaces 111, 131, and 112, 132, the studs 153, 154 will contact the counterbores 173, 174 in maximum opposite positions of relative pivoting of the elements 11, 13. Thus, the latter cooperation between the studs 153, 154 and the cross-bores 173, 174 functions as the stop means or limits for relative pivoting of the links 11, 13 to thus prevent studs/counterbores/pivot pin exposure even in the absence of the surfaces 11, 131 and 112, 132. Thus, the cross-bores 171, 172, 173 and 174 function as stops in conjunction with their respective studs, 151–154 to limit maximum opposite pivot positions of the links or elements 11, 13.

Figure 4:
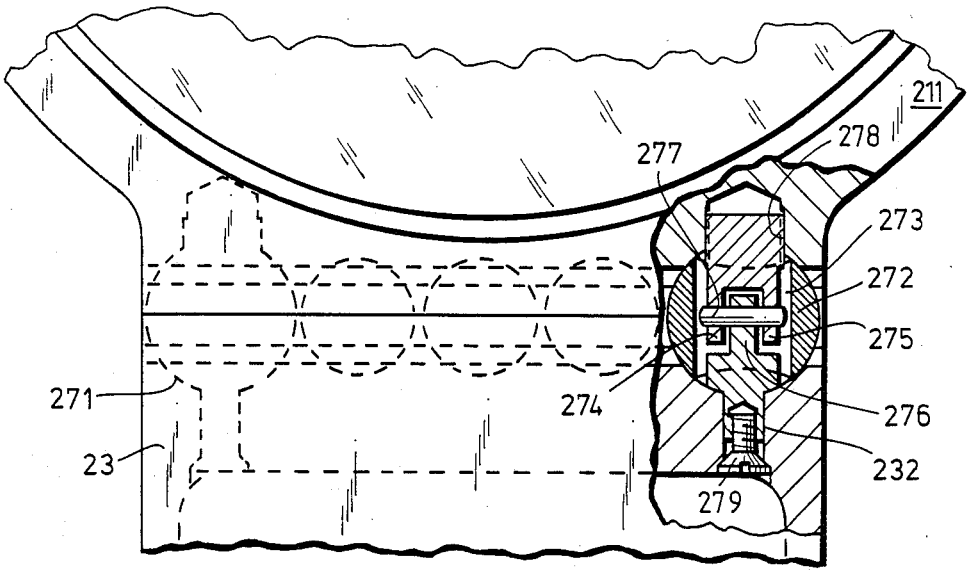
FIG. 4 is a fragmentary top-plan view of another watch wristband and illustrates two cylindrical housings each associated with a pair of pivoted studs for securing a terminal link or connection element to the associated watch casing.

Reference is now made to FIG. 4 of the drawings which illustrates another embodiment of the invention wherein a watch housing or element 211 is connected to a connection or element 23 of a watchband through a pair of hinges or articulate connections 271, 272 which in lieu of the cylinder or cylindrical housing 17 are instead spherical housings 271, 272 each having a diametrically position cross-bore 273. The spherical housings 271, 272 are seated in semi-spherical opposing recesses (unnumbered) of the elements 23, 211. A pair of studs or eyes are partially housed within the cross-bore 273, one of the studs being defined by a pair of legs 274, 275 and the other stud by an arm 276 with the latter being pivotally interconnected by a pivot pin 277. The stud 274, 275 is threaded at its end remote from the pivot pin 277 and this end is threaded into a threaded bore 278 of the element or watch case 211. A reduced (unnumbered) of the stud 276 is received in a reduced bore 232 of the element 23 and is connected therein by a suitable set screw 279 through the exposed and recessed lower end portion (unnumbered) of the link 23. Hence, by removing the screw 279 through the access provided by the recess at the bottom of the link 23, the connection or hinge 272 can be assembled/disassembled/reassembled and identical structure is similarly associated with the hinge 271.

The housing 272 similarly hides the connection element and/or the components thereof including the studs 274–276 and the pivot pin 277 through the gaps (unnumbered) at the top and bottom as pivoting occurs between the elements 23, 211. It should be particularly noted that the fragmentary portion at the right-hand side of FIG. 1 has been taken through the diametric center of the housing 272 in a horizontal plane and thus all of the internal components within the cross-bore 273 are visible. However, the spherical housing 272 is completely closed at its top and bottom, again as viewed in FIG. 4, and therefore the gap at the top and bottom will expose nothing more than the exterior surface (unnumbered) of the spherical housing 272.

Three other smaller spheres are shown in FIG. 4 between the hinges 271, 272, and these may include similar though smaller hinges or connecting elements or may simply enclose solid blind spheres for esthetic purposes.

Although in a preferred embodiment of the invention as has been specifically illustrated and described herein, it is to be understood that minor variations may be made in the application without departing from the spirit and scope of the invention, as defined in the appended claims.

What is claimed is:

1. A wristband, such as a bracelet, watchband or the like, comprising means for defining a band having a longitudinal axis and being adapted to generally encircle a person's wrist or the like, said band including a hinge defined by two elements having contiguous opposing edge portions disposed generally transverse to the longitudinal axis of said band, said two elements each having opposite first and second surface portions at opposite sides of and generally spanned by the respective opposing edge portions thereof, one of said elements being a band connecting link, said contiguous opposing edge portions cooperatively defining a space therebetween, pivotal connecting means in said space for pivotally connecting said elements to each other for movement between a plurality of positions of relative movement, housing means in said space separate from said pivotal connecting means for substantially enclosing said pivotal connecting means whereby said pivotal connecting means cannot be seen from the exterior in any operative relative pivoted position of said elements, and said housing means being substantially hidden from exterior view by said first surface portions of said two elements in one position of said plurality of positions of relative movement.

2. The wristband as defined in claim 1 wherein said housing means is defined by a surface of revolution.

3. The wristband as defined in claim 1 wherein said housing means is generally spherical.

4. The wristband as defined in claim 1 wherein said housing means is generally cylindrical.

5. The wristband as defined in claim 1 wherein said chamber and housing means are generally spherical.

6. The wristband as defined in claim 1 wherein said chamber and housing means are generally cylindrical.

7. The wristband as defined in claim 1 wherein said pivotal connecting means includes a pivot pin within said housing means, a pair of studs connected pivotally to each other by said pivot pin, and means for connecting one stud to each of said elements.

8. The wristband as defined in claim 1 wherein said pivotal connecting means includes a pivot pin within said housing means, a pair of studs connected pivotally to each other by said pivot pin, and means for connecting one stud to each of said elements through said housing means.

9. The wristband as defined in claim 1 wherein said pivotal connecting means includes a pivot pin within said housing means, a pair of studs connected pivotally to each other by said pivot pin, and means for connecting one stud to each of said elements through bores of said housing means.

10. The wristband as defined in claim 7 wherein said housing means is generally spherical.

11. The wristband as defined in claim 7 wherein said housing means is generally cylindrical.

12. The wristband as defined in claim 10 wherein the stud-to-element connecting means includes a bore in each element having an axis disposed generally normal to an axis of said pivot pin.

13. The wristband as defined in claim 10 wherein said stud-to-element connecting means includes a bore in each element having an axis disposed generally normal to an axis of said pivot pin, and threaded means for threadedly securing each stud in its associated bore.

14. The wristband as defined in claim 11 wherein said stud-to-element connecting means includes a bore in each element having an axis disposed generally normal to an axis of said pivot pin.

15. The wristband as defined in claim 11 wherein the stud-to-element connecting means includes a bore in each element having an axis disposed generally normal to an axis of said pivot pin, and threaded means for threadedly securing each stud in its associated bore.

16. The wristband as defined in claim 12 wherein one of said studs includes a pair of arms and the other of said studs includes a leg positioned between said arms, and said pivot pin connects said arms and leg pivotally to each other.

17. The wristband as defined in claim 13 wherein one of said studs includes a pair of arms and the other of said studs includes a leg positioned between said arms, and said pivot pin connects said arms and leg pivotally to each other.

18. The wristband as defined in claim 14 wherein each stud has a through opening receiving said pivot pin.

19. The wristband as defined in claim 15 wherein each stud has a through opening receiving said pivot pin.

20. The wristband as defined in claim 1 wherein said first surface portions are in edge-abutment in said one postion.

21. The wristband as defined in claim 1 including means for connecting said pivotal connecting means through said housing means to said elements.

22. The wristband as defined in claim 20 including means for connecting said pivotal connecting means through said housing means to said elements.

23. The wristband as defined in claim 7 including aperture means in said housing means through which said one stud is connected to each element.

* * * * *